US006402086B1

(12) United States Patent
Myers, Jr.

(10) Patent No.: US 6,402,086 B1
(45) Date of Patent: Jun. 11, 2002

(54) PAPER ROLLER INCLUDING PROMOTIONAL INDICIA

(76) Inventor: Victor E. Myers, Jr., 6349 E. Yosemite Ave., Orange, CA (US) 92867

( * ) Notice: Subject to any disclaimer, the term of this patent is extended or adjusted under 35 U.S.C. 154(b) by 0 days.

(21) Appl. No.: 09/559,938

(22) Filed: Apr. 27, 2000

(51) Int. Cl.[7] ..... B65H 75/14
(52) U.S. Cl. ..... 242/600
(58) Field of Search ..... 242/600, 912

(56) References Cited

U.S. PATENT DOCUMENTS 839,439 A * 12/1906 Underdown ..... 242/160.4
5,887,811 A * 3/1999 Tsutsumi ..... 242/322

* cited by examiner

*Primary Examiner*—Emmanuel M. Marcelo
(74) *Attorney, Agent, or Firm*—Price and Gess

(57) ABSTRACT

An improved paper roller for carrying sheets of product such as bathroom tissue, paper towels, aluminum foil, cellophane wrap, gift wrap, and the like is presented, the improvement being the inclusion of promotional printed indicia on the roller. The promotional indicia can be applied directly to the paper roller, or on separate sheets attached to the roller. Scoring, adhesive edges, and tear-away tabs are disclosed for attaching the separate sheets to the roller for easy detachment. The promotional indicia can take the form of manufacturer's coupons, advertisements, rebates, contest entry forms, or consumer information on products.

15 Claims, 2 Drawing Sheets

PAPER ROLLER INCLUDING PROMOTIONAL INDICIA

BACKGROUND OF THE INVENTION

1. Field of the Invention

The present invention relates generally to paper rollers, and more particularly to an improved paper roller with promotional indicia such as a manufacturer's coupon or advertisement on the roller.

2. Description of Related Art

Many products today are sold on a cardboard or heavy paper roller, such as for example paper towels, cellophane wrap, aluminum foil, bathroom tissue, and gift wrapping paper. In each of these examples, sheets of product is wound around the paper roller and unwound as needed by the purchaser. When the consumer reaches the end of the roll of product, the bare roller is discarded and a new roll of product replaces the old. If there is not a replacement roll handy at the time the old roll is empty, the purchaser must go out and replace the old roll with a new one at this time. Curiously, at a time when manufacturers know that their product is in demand and that the consumer is likely to buy either a similar product or a competitor's product, the empty roller has not be utilized as an advertising vehicle to influence the consumer's next purchase.

SUMMARY OF THE INVENTION

The present invention seeks to take advantage of the unique opportunity presented when a consumer runs out of a product which uses a paper roller by including a promotional message on the roller. Whether the printed indicia which is used to convey the promotional message is incorporated directly on the paper roller itself, or whether a separate sheet of paper is attached to the outside of the roller, the present invention takes advantage of the timing and attention required to change the discarded roller by supplying a promotional message to the consumer on the empty roller. The present invention discusses several vehicles for communicating this message, such as scoring the paper roller to facilitate a cut-out or tear-out coupon, to printing a message on the entire roller. With the present invention a manufacturer can attempt to influence the consumer's next purchase by offering discounts, consumer information, or other incentives such as sweepstakes entry.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an improved paper roller of the type wound sheets of consumer products are distributed on, where the improvement lies in the inclusion of promotional indicia on or attached to the roller.

Figure 1:
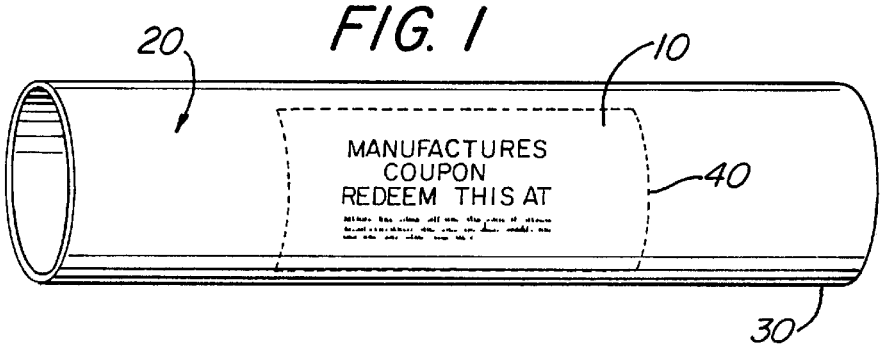
FIG. 1 is a perspective view of a roller including a first embodiment of the present invention illustrating printed indicia directly on the paper roller with a scored border.

FIG. 1 illustrates a cardboard roller of the type commonly sold with commercial products such as bathroom tissue, paper towels, aluminum foil, and the like. In a first embodiment of the present invention, promotional printed indicia 10 is applied directly to the outer surface 20 of the roller 30. Promotional indicia 10 can comprise a manufacturer's coupon offering a discount on subsequent purchases, consumer information comparing a manufacturer's product with that of a competitor, advertisements speaking to the benefits of the manufacturer's products, gaming or promotional giveaways, such as contest entry forms or information, sweepstakes entry forms or information, or similar types of promotional indicia To present the printed indicia 10 on the roller 30, ink may be injected directly into the paper roller prior to winding the product on the roller. The indicia and any other images will appear to the consumer once the roll of product has been depleted. Because empty rollers are not replaced immediately in some households, the roller with the printed indicia may be present in the consumer's view for some time before it is eventually replaced with a new roll. This, plus the novelty of seeing an image on a roller when heretofore no image existed, will provide an excellent opportunity for the manufacturer to make an impression on the consumer's mind.

Figure 2:
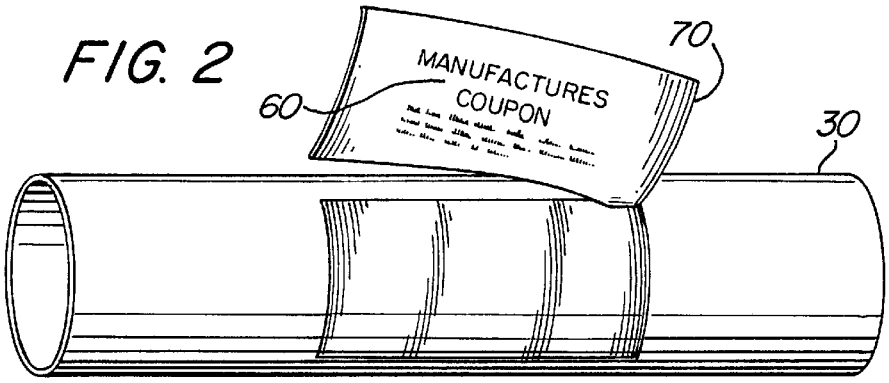
FIG. 2 is a perspective view of a roller including a second embodiment of the present invention illustrating a first removable layer of the roller including printed indicia.
Figure 3:
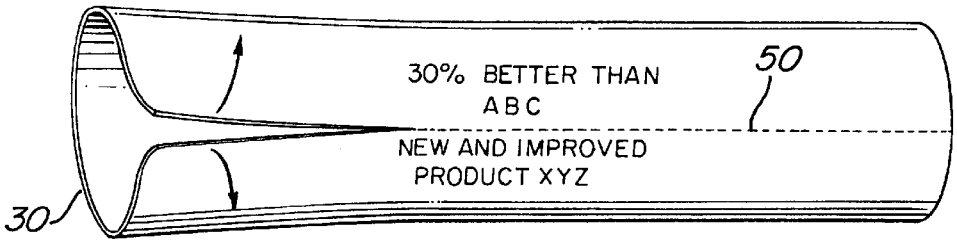
FIG. 3 is a perspective view of a roller including a third embodiment of the present invention illustrating a scoring along a longitudinal direction separating the roller into a planar sheet.

FIG. 1 shows an improved roller of the present invention with promotional indicia printed directly on the roller. The printed indicia can take up the entire roller, or it could comprise a portion of the roll. Further, as seen in FIG. 1, score lines 40 can be used to facilitate removing the printed indicia 10 from the remainder of the roller 30 as may be the case for a redeemable manufacturer's coupon. Here, score lines 40 around the border of the manufacturer's coupon permit the consumer to remove the coupon from the roller 30 quickly and easily, allowing the consumer to take the coupon to the store for redemption. Score lines 50 can also be used longitudinally along the roller to separate the roller into a planar sheet (see FIG. 3). As a planar sheet the once-cylindrical roller can be used to write on, in the case of sweepstakes entries preprinted on the roller, or convey a larger advertisement than that allowed by the cylindrical roller. Also, since paper rollers are typically comprised of multilayers of paper, the printed indicia forming a coupon 60 could be printed on an upper layer 70 of the roller 30 and scored for easy removal from the other layers of the roller 30 (see FIG. 2).

Figure 4:
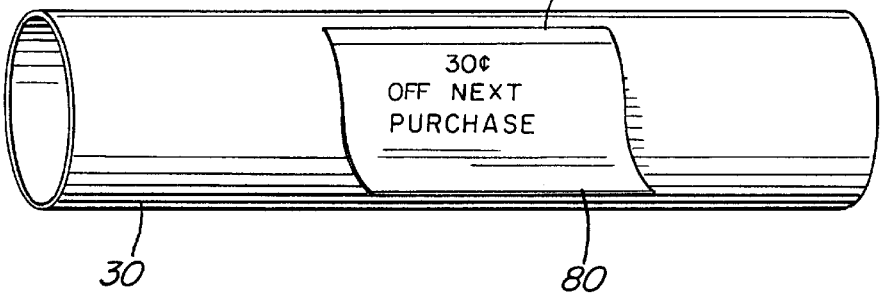
FIG. 4 is a perspective view of a roller including a fourth embodiment of the present invention illustrating a removable coupon attached along a first edge.

In addition to applying the printed indicia directly on the paper roller, it is a further concept of the present invention to affix a paper containing the printed promotional indicia to the outer surface of the roller. Referring to FIG. 4, a separate sheet of paper 80 such as a manufacturers coupon is affixed to the roller 30 such that the coupon can be easily removed from the roller without tearing. Adhesives can be used to affix the coupon to the roller—typically one edge 90 of the coupon could be affixed but more edges can be adhesively applied to the roller. Once the product such as bathroom tissue or paper towels are used up, the consumer merely has to remove a coupon prevalently mounted on the roller and redeem the coupon at the time of repurchase. In this manner, a manufacturer can generate repeat business and influence the sale of its products to its current customers or promote other products to its customers.

Figure 5:
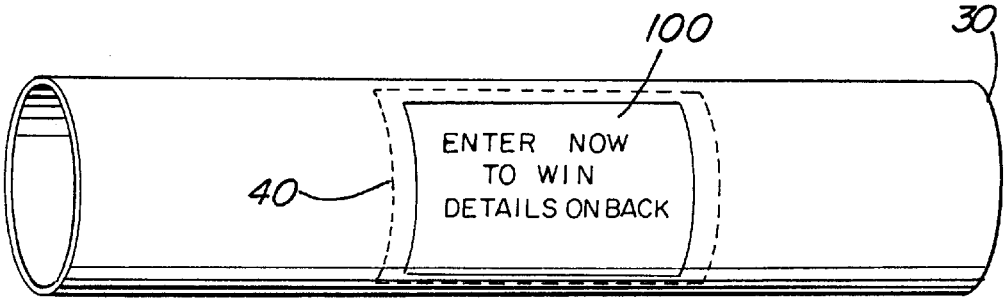
FIG. 5 is a perspective view of a roller including a fifth embodiment of the present invention illustating a coupon with printed indicia affixed to the roller with a scored border.
Figure 6:
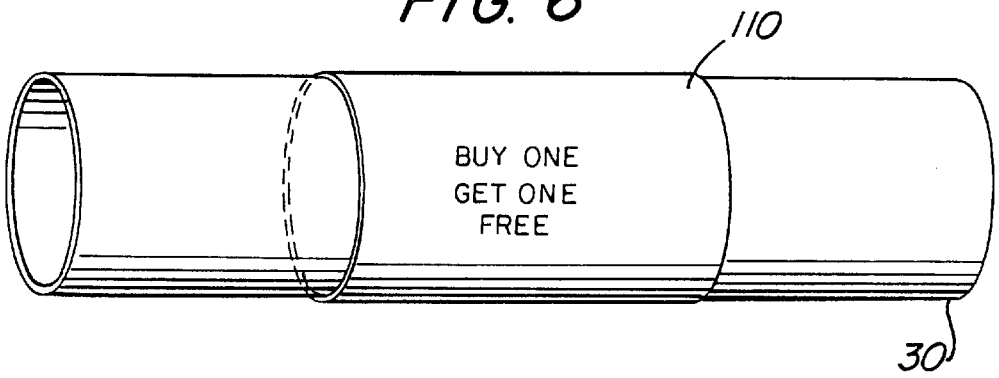
FIG. 6 is a perspective view of a roller including a sixth embodiment of the present invention illustrating a removable sleeve with printed indicia on the roller.
Figure 7:
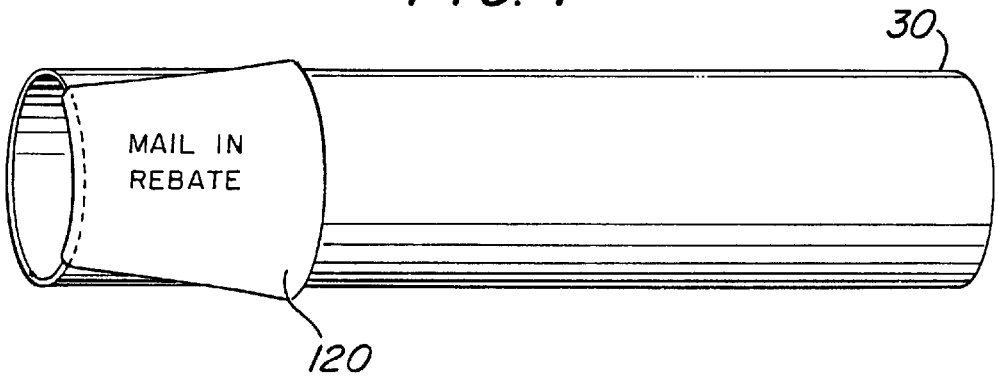
FIG. 7 is a perspective view of a roller including a seventh embodiment of the present invention illustrating a removable tab connected to the roller.

There are other ways contemplated by the present invention for communicating the printed indicia to the consumer on the empty paper roller. A coupon 100 could be affixed to the roller 30 directly, and scoring 40 along the border could facilitate removing the coupon from the roller as shown in FIG. 5. Also, as seen in FIG. 6 a cylindrical sleeve 110 can be placed around the roller 30, such that the sleeve with the promotional indicia can easily be removed once the product on the roller is exhausted. The sleeve 110 could have scoring to separate the sleeve into a rectangular coupon. In FIG. 7 a tab 120 folded over the cylindrical roller and easily detachable from the roller is shown, such that a consumer need only tear away an attached portion of the tab to separate the coupon 120 from the roller 30.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An improved paper roller for receiving a wound sheet of dispensable product, said improvement comprising printed promotional indicia on a first surface and wherein said printed promotional indicia comprises a manufacturer's coupon.

2. An improved paper roller for receiving a wound sheet of dispensable product, said improvement comprising printed promotional indicia on a first surface and wherein said printed promotional indicia comprises a contest entry form.

3. An improved paper roller for receiving a wound sheet of dispensable product, said improvement comprising printed promotional indicia on a first surface and further comprising a scored border around said printed promotional indicia.

4. The improved paper roller of claim 3, wherein said paper roller comprises a plurality of paper layers and said printed promotional indicia is formed on a first removable paper layer.

5. An improved paper roller for receiving a wound sheet of dispensable product, said improvement comprising printed promotional indicia on a first surface and wherein said roller includes a longitudinal scoring from a first end to a second end, and upon separation of said roller along said scoring said roller is transformed into a planar sheet with said promotional indicia thereon.

6. The improved paper roller of claim 5 wherein said printed indicia is located on both sides of said planar sheet.

7. An improved paper roller for receiving a wound sheet of dispensable product, said improvement comprising a removable sheet with promotional indicia, affixed thereto along a first edge of said removable sheet.

8. The improved paper roller of claim 7 wherein said sheet with promotional indicia comprises a manufacturer's coupon.

9. The improved paper roller of claim 7 wherein said sheet with promotional indicia comprises an advertisement.

10. The improved paper roller of claim 7 wherein said sheet with promotional indicia comprises a contest entry form.

11. The improved paper roller of claim 7 wherein said sheet with promotional indicia is adhesively affixed along a first edge.

12. The improved paper roller of claim 7 wherein said sheet with promotional indicia is adhesively affixed along first and second opposite edges.

13. The improved paper roller of claim 7 wherein said removable sheet with promotional indicia is permanently affixed to a portion of said paper roller, said removable sheet with said included portion of said roller removable from the remainder of said roller along score lines.

14. The improved paper roller of claim 7 wherein said removable sheet with promotional indicia forms a sleeve about the roller, where said sleeve can be removed once the roller is empty.

15. The improved paper roller of claim 7 wherein said removable sheet with promotional indicia is removably attached to said roller along an edge of the roller.

* * * * *